US005428870A

United States Patent [19]

Rutz et al.

[11] Patent Number: 5,428,870

[45] Date of Patent: Jul. 4, 1995

[54] METHOD AND DEVICE FOR REGULATING THE DRAW OF A DRAWING UNIT

[75] Inventors: Hansjörg Rutz, Arbon; Francois Baechler, Wermatswil, both of Switzerland

[73] Assignee: Zellweger Luwa AG, Uster, Switzerland

[21] Appl. No.: 129,096

[22] PCT Filed: Feb. 26, 1993

[86] PCT No.: PCT/CH93/00049

§ 371 Date: Oct. 5, 1993

§ 102(e) Date: Oct. 5, 1993

[87] PCT Pub. No.: WO93/18213

PCT Pub. Date: Sep. 16, 1993

[30] Foreign Application Priority Data

Mar. 5, 1992 [CH] Switzerland ..... 00701/92

[51] Int. Cl.[6] ..... D01H 5/38

[52] U.S. Cl. ..... 19/240

[58] Field of Search ..... 19/236, 240, 241, 238, 19/239, 297

[56] References Cited

U.S. PATENT DOCUMENTS

| | | | |
|---|---|---|---|
| 3,088,175 | 5/1963 | Aoki | 19/240 |
| 3,099,048 | 1/1963 | Locher | 19/240 |
| 3,938,223 | 2/1976 | Grice | 19/240 |
| 4,137,487 | 1/1979 | Niestruj et al. | 19/240 X |
| 4,369,550 | 1/1983 | Meile | 19/240 |
| 4,473,924 | 10/1984 | Hartmanngruber et al. | 19/293 X |
| 4,864,853 | 9/1989 | Grunder et al. | 19/240 |
| 5,003,668 | 4/1991 | Meyer | 19/22 |
| 5,018,248 | 5/1991 | Haworth et al. | 19/240 |
| 5,022,123 | 6/1991 | Ueda et al. | 19/240 |
| 5,134,755 | 8/1992 | Jornot et al. | 19/239 |
| 5,161,284 | 11/1992 | Leifeld | 19/260 |

FOREIGN PATENT DOCUMENTS

| | | |
|---|---|---|
| 0038927 | 11/1981 | European Pat. Off. . |
| 0354653 | 2/1990 | European Pat. Off. . |
| 0252952 | 4/1990 | European Pat. Off. . |
| 0380923 | 8/1990 | European Pat. Off. . |
| 0411379 | 2/1991 | European Pat. Off. . |
| 4103525 | 10/1991 | Germany . |
| 650280 | 10/1980 | Switzerland . |

OTHER PUBLICATIONS

"Autolevelling Systems at Carding and Drawing from a Technological Point of View", *Uster News Bulletin*, No. 30, pp. 1–22 (Aug. 1982).

*Primary Examiner*—Clifford D. Crowder
*Assistant Examiner*—Ismael Izaguirre
*Attorney, Agent, or Firm*—Burns, Doane, Swecker & Mathis

[57] ABSTRACT

A drawing unit contains two drawing zones, one of which is variable and driven by two motors. The desired draw is set by means of a control of the speed of one of the motors, preferably of the motor for the pre-drawing zone. This control of the speed is carried out by way of a draw correction value which is calculated from the deviation between the desired draw and the actual draw calculated from the speed of the fibre sliver at the entrance and at the exit of the drawing unit. This draw regulation allows a rapid reaction to fluctuations in the draw, simple correcting measures and drift-free operation.

15 Claims, 2 Drawing Sheets

1
2
3
4
5
6
7
8
8
9
12
13
14
14
14
14
15
15
16
17
18
19
20
21
22
23
24
25
26
27
28
29
30
31
32
HV
VV
F
RE

METHOD AND DEVICE FOR REGULATING THE DRAW OF A DRAWING UNIT

FIELD OF THE INVENTION

The present invention relates to a method for regulating the draw of a drawing unit, in which each drawing zone formed by pairs of rollers is driven by a separate motor and the desired draw is adjustable by means of a corresponding control of the speed of the motors.

BACKGROUND OF THE INVENTION

CH-A-650,280 describes a drawing frame which, for each pair of rollers, has a separate drive motor, the speed of which is adjustable by means of a frequency divider. A computer containing an input and an indicator device calculates the speed ratios for the motors according to the input data and adjusts the drawing frame accordingly. The computer can also be assigned a measuring member for the fineness of the fibre sliver, from the measurement signal of which can be derived a non-uniformity signal characterising the non-uniformity of the fibre sliver.

When deviations of the draw from the input values occur on this drawing frame, these can be recognised only indirectly from their effects on the non-uniformity of the fibre sliver. This method of regulating the draw by means of the fibre sliver constitutes a so-called long-time regulation which, in view of its inertia, cannot satisfy the practical demands for a regulation of the draw. In addition, the deviations in the draw become noticeable as non-uniformity of the sliver only when a particular value is exceeded, and therefore, in particular, a drift of the system as a whole can be recognised only with great difficulty by means of the non-uniformity of the sliver.

SUMMARY OF THE INVENTION

Therefore, the invention is intended to provide a regulation of the draw which allows a rapid reaction to fluctuations in the draw and in which the necessary corrections can be made as simply as possible and which permits as drift-free an operation as possible.

In a method of the type mentioned in the introduction, this object is achieved by means of the following steps:

a. Measurement of the entry speed of the fibre slivers into the drawing unit;
b. Measurement of the exit speed of the fibre slivers from the drawing unit;
c. Calculation of the actual draw from said measurement values;
d. Comparison of the actual draw with the desired draw and determination of the deviation between these;
e. Calculation of a draw correction value from this deviation;
f. Superposition of the draw correction value with the nominal control quantity; and
g. Regulation of the speed of one of the motors by means of the calculated quantity.

The method according to the invention is based on forward compensation which is also designated as desired-quantity integration. In addition to the rapid reaction to fluctuations in the draw and the possibility of simple execution of corrections, it is characterised, in particular, in that the system is independent of drift. In fact, the system has no overall drift, because a possible drift of individual components is corrected out.

The invention relates, furthermore, to a device for carrying out said method, with a drawing unit consisting of pairs of rollers and having a constant and a variable drawing zone, with drive motors assigned to the pairs of rollers, and with a regulating unit for adjusting the drawing frame.

The device according to the invention is characterised in that the variable drawing zone is assigned two drive motors, in that first and second means for measuring the sliver speed at the entrance and at the exit of the drawing unit respectively are provided, and in that said means are connected to the regulating unit, in which an evaluation of the measured sliver speed takes place, and in that one of the two drive motors is designed as a variable-speed motor and is controlled by the regulating unit.

BRIEF DESCRIPTION OF THE DRAWING FIGURES

The invention is explained in more detail below by means of exemplary embodiments and the drawings; in these:

FIG. 1 shows a basic diagram of a draw regulation according to the invention in a drawing frame; and FIG. 2 shows a diagram of a drawing frame with a draw regulation according to the invention and a sliver-regulating control in a representation different from that of FIG. 1.

DETAILED DESCRIPTION OF THE PRESENT INVENTION

Figure 1:
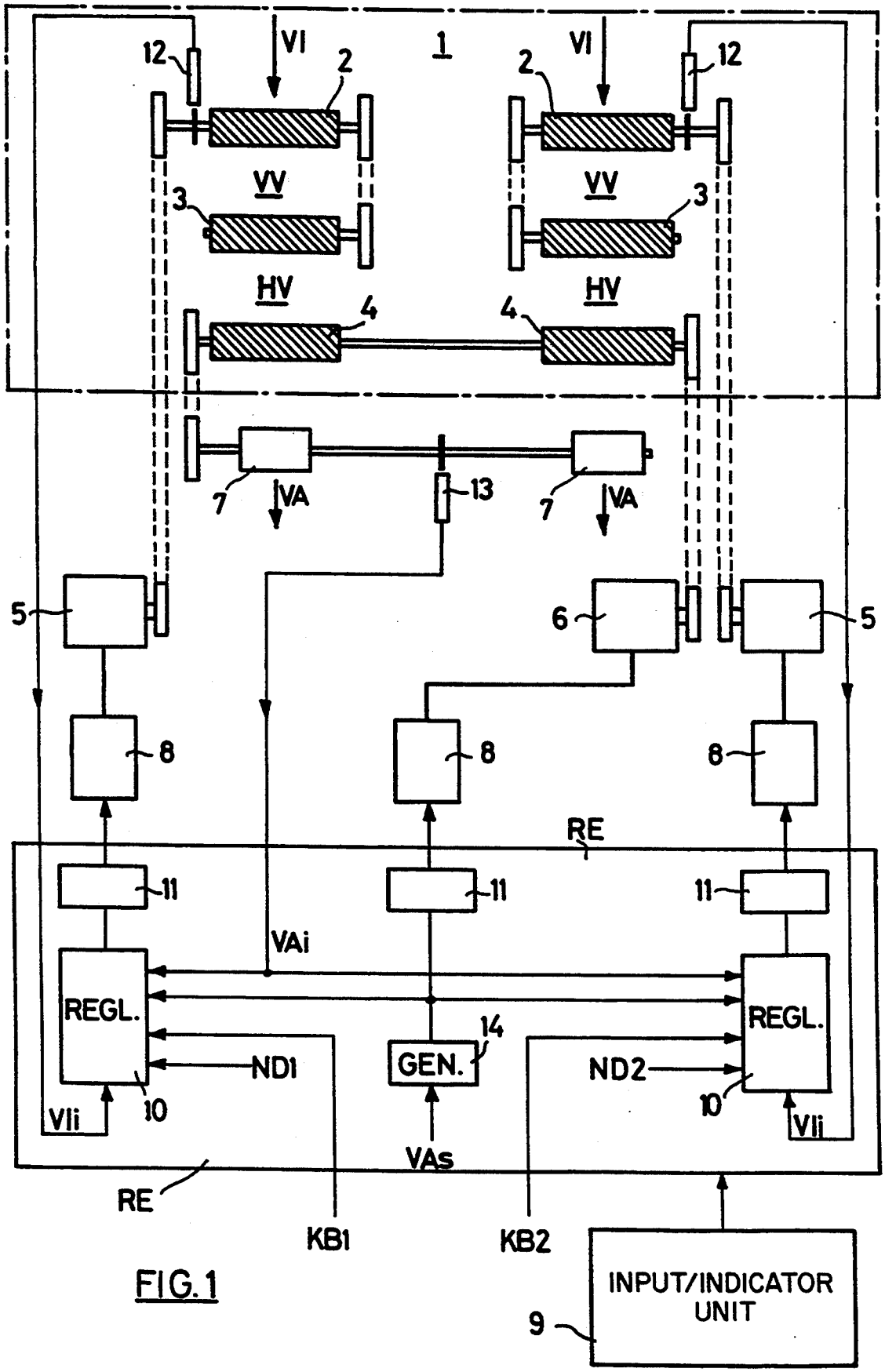

FIG. 1 illustrates a drawing unit of a two-headed drawing frame for the folding or drawing of fibre slivers, to which two groups of fibre slivers are fed in the direction of the arrows VI and which delivers two fibre slivers at its exit (arrows VA). However, the arrangement of two deliveries is not essential to the invention, nor is the invention restricted to drawing frames of this type.

As illustrated, the drawing unit 1 consists of three pairs of rollers 2, 3 and 4, a predrawing zone VV being formed between the pairs of rollers 2 and 3 at the front in the run-through direction of the fibre slivers (arrows VA and VI), and a main drawing zone HV being formed between the pairs of rollers 3 and 4 at the rear in the run-through direction. Both the predrawing zone VV and the main drawing zone HV are each assigned a drive motor 5 and 6.

The drive motor 5 for the predrawing zone VV directly drives one of the two pairs of rollers of the latter, as illustrated the pair of rollers 2 which is located at the entrance and which is itself coupled mechanically to the other pair of rollers 3 and drives this in an adjustable transmission ratio. The drive motor 6 of the main drawing zone HV directly drives the pair of rollers 4 which is located at the exit and which is coupled to a pair of delivery rollers 7. There is therefore no mechanical coupling between the two drawing zones, since both are driven by their own motor.

The two motors 5 for the pairs of rollers 2 and 3 are variable-speed motors and the motor 6 for the pair of rollers 4 is a main motor. The latter regulates the exact production speed of the system by means of its speed, whereas the entry speed of the fibre slivers into the drawing unit 1 is dependent on the speeds of the variable-speed motors 5. Thus, at a given speed of the main motor 6, the draw is dependent on the speed of the variable-speed motors 5. The speeds of the two variable-speed motors 5 can be regulated independently of one another; thus, at the same delivery speed by the delivery rollers 7, different draws can be set at the two deliveries. All the motors are assigned corresponding servo-amplifiers 8 which have their own speed and current regulation. Moreover, all the motors 5 and 6 are controlled by a common regulating unit RE, to which an input/indicator unit 9 is assigned.

The regulating unit RE contains, for each of the two drawing frames, a controller 10 which controls the speed of its variable-speed motor 5 by way of a fast control path and regulates it by way of a slow regulating path. The regulating unit receives from measuring members (not shown) of the type described in EP-B-0,252,952 signals which represent a sliver count and from these signals generates draw correction values KB1 and KB2 for the sliver count which are used in the control path. Apart from these draw correction values KB1 and KB2, the control path does not use any further measurement values, but only parameters which are partially input via the input/indicator unit 9 and partially calculated in the regulating unit RE. These parameters are the delivery speed VAs preset in a generator 14 and the total draw ND1 and ND2, from which, together with the draw connection values KB1 and KB2, the respective entry speed VI is calculated. The calculation and output of these values in corresponding output stages 11 preceding the servo-amplifiers 8 takes place within a sensing cycle.

The controllers 10 are, for the regulating path, so-called integral controllers (the output quantity is proportional to the time integral of the input quantity) and, for the control path, proportional controllers (the output quantity is at all times proportional to the input quantity). They have the function of regulating out deviations in the draw, faults in the drawing unit, nonlinearities of the actuators, temperature drift, mechanical play and slip. The actual draw is calculated by means of the effective entry speed VIi and the effective delivery speed VAi. A comparison of the actual draw and the desired draw gives the draw deviation, from which the controller 10 calculates a draw correction value which is then fed into the control path. The calculation of a draw correction value takes place within a sensing cycle; the speed at which a draw error is corrected out in this control loop is dependent on the integration time of the integral controller 10, on the sensing time and on the reaction time of the actuators (loaded motor 5 and servo-amplifier 8).

The measurement of the effective entry speed VIi and of the effective delivery speed VAi is carried out by speed sensors 12 on the pairs of entry rollers 2 and by a speed sensor 13 on the pair of delivery rollers 7, the signals from said sensors being evaluated via a special interface.

To regulate the draw, the roller diameters, the nominal speeds of the motors, the parameters of the speed sensors (for example, tacho-wheel, correction factor) and the various controller parameters have to be input via the input/indicator unit 9. The delivery speed VAs and the total draw ND can be varied via the input/indicator unit 9.

Figure 2:
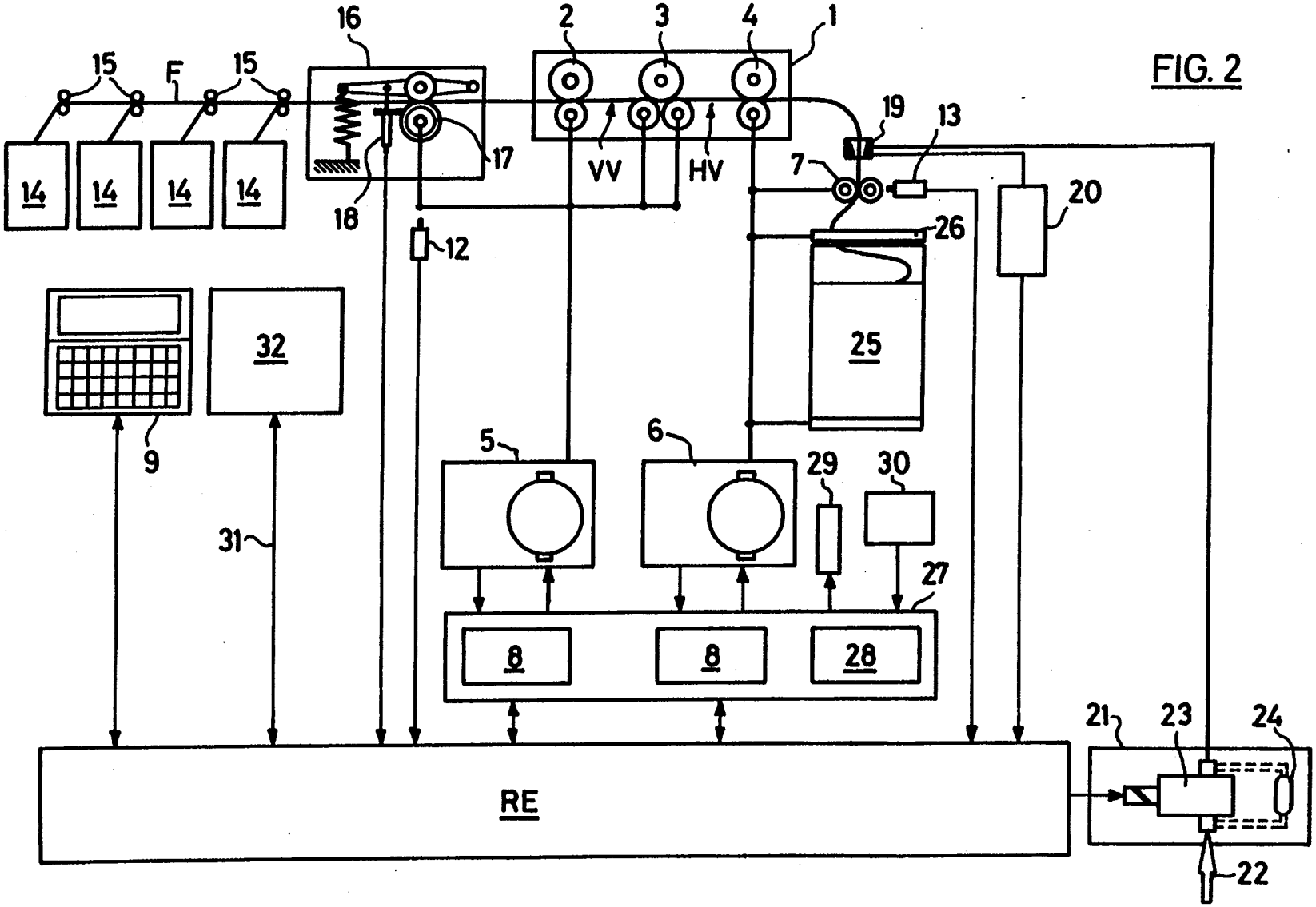

FIG. 2 shows the design of a complete regulating system in a diagrammatic longitudinal section through the drawing unit. As illustrated, a fibre sliver F is drawn out by means of a pair of rollers 15 from each of the feed cans 14, of which, for example, six or eight are provided. The fibre slivers F then run through a feed measurement unit 16 for the sliver control, which, as illustrated, is formed by a so-called grooved-and tracer-roller measuring member 17 (see in this respect, for example, U.S. Pat. No. 3,938,223) and which has, in addition to the actual measuring member 17, a displacement sensor 18 for its evaluation.

The fibre slivers F subsequently pass into the drawing unit 1 having the pairs of rollers 2, 3 and 4 and acquire a constant predraw in the predrawing zone VV and a variable main draw in the main drawing zone HV. The speed sensor 12 for measuring the effective entry speed VIi (FIG. 1) is designed as a tacho generator. The time delay for the controller is determined in the regulating unit RE as a function of the entry speed VIi and of various spacings (measuring-member/drawing-unit spacing, roller spacings).

A measuring member 19 for monitoring the quality of the sliver produced is arranged at the exit of the drawing unit 1 and is preferably formed by a so-called fibre-compression measuring funnel of the type described in U.S. Pat. No. 4,864,853. This is assigned, on the one hand, a preamplifier 20 and, on the other hand, a cleaning unit 21, from which compressed air 22 for cleaning and cooling is fed to the measuring member 19. The cleaning unit 21 contains a controlled three-way valve 23 and a bypass 24 for the cooling. Cooling thus takes place constantly and cleaning sporadically, the three-way valve 23 being controlled by the regulating unit RE.

After the measuring member 19, the sliver runs through the pair of delivery rollers 7, the speed sensor 13 of which is likewise designed as a tacho generator. This measures the delivery speed of the sliver produced, from which the production data are determined in the regulating unit RE. After the pair of delivery rollers 7, the sliver passes into a depositing can 25 which is arranged on a driven turntable and at the entrance of which a likewise driven head plate 26 is arranged.

Furthermore, the Figure shows the main motor 6 and the variable-speed motor 5 of the regulating stage and a power unit 27 which has the servo-amplifiers 8 for said motors and a power pack 28 with a ballast control for the main motor 6. The reference symbol 29 denotes a ballast resistor for the main motor 6, and 30 denotes a three-phase transformer for the power unit 27. In addition to the connection with the input/indicator unit 9, the regulating unit RE also has an interface 31 to a switchbox 32 for the machine, which serves, in particular, for switching off, alarm indication, clearance for regulation, can-change control and the like.

The draw regulation illustrated can be employed for the following types of sliver-count regulation:

open-loop sliver-count regulation
closed-loop sliver-count regulation
open-loop and closed-loop sliver-count regulation.

These types are known to the average person skilled in the art and are described, for example, in USTER News Bulletin No. 30 of June 1982.

We claim:

1. Method for regulating the draw of a drawing unit, in which drawing zones are formed by pairs of rollers which are driven by a separate motor and in which a desired draw is adjustable by controlling a speed of the motors, comprising:

measuring an entry speed of fibre slivers entering the drawing unit;

measuring an exit speed of the fibre slivers exiting from the drawing unit;

calculating an actual draw of the drawing unit based on the measured exit and entry speeds;

comparing the actual draw with the desired draw and determining a deviation between the actual draw and the desired draw;

calculating a draw correction value from the determined deviation;

utilizing the draw correction value to derive a control value for use in regulating the speed of one of the motors; and regulating the speed of one of the motors by means of the control value to vary at least one of the entry speed and the exit speed of the fibre slivers.

2. Method according to claim 1, in which the drawing unit has a predrawing zone and a main drawing zone, and wherein the motor for driving the rollers forming the predrawing zone is a variable-speed motor and is regulated by means of said draw correction value.

3. Method according to claim 2, wherein the motor for driving the rollers forming the main drawing zone is a main motor, and including setting the speed of the main motor by means of a desired production speed.

4. Method according to claim 2, wherein the entry speed of the sliver into the drawing unit is controlled by way of a control path and is regulated by way of a regulating path based on the speed of the variable-speed motor.

5. Method according to claim 4, wherein the control of the variable-speed motor by way of the control path includes calculating a desired entry speed of the sliver from a predetermined exit speed and from a desired total draw.

6. Method according to claim 5, wherein the calculation of the desired entry speed of the sliver is achieved by taking into account count fluctuations of the sliver at an entrance or an exit of the drawing unit.

7. Method according to claim 4, wherein the regulation of the variable-speed motor by way of the regulating path includes inputting the calculated draw correction value into the control path.

8. System for regulating a draw of a drawing unit that includes a predrawing zone and a main drawing zone, the main drawing zone being formed by two rollers, the system comprising two drive motors connected to the rollers forming the main drawing zone, one of said motors being a variable-speed motor, first measuring means for measuring a sliver speed at an entrance to the drawing unit, second measuring means for measuring a sliver speed at an exit from the drawing unit, a regulating unit to which the first and second measuring means are connected for evaluating a speed of the sliver measured by the first and second measuring means, said variable-speed motor being connected to and controlled by the regulating unit.

9. System according to claim 8, including a variable-speed drive motor connected to the rollers forming the predrawing zone.

10. System according to claim 9, wherein the motors connected to the rollers forming the predrawing zone and the main drawing zone are connected to and controlled by the regulating unit, each of the motors having a servo-amplifier connected thereto for regulating speed and current.

11. System according to claim 8, wherein the regulating unit includes a computer, an integral-action controller and an input/indicator unit for inputting data used in regulating the draw of the drawing unit.

12. System according to claim 11, wherein the first and second measuring means include tacho generators.

13. System according to claim 11, wherein the drawing unit is preceded by a feed measurement unit having a measuring member for measuring a cross-section of the sliver, said regulating unit being connected to the measurement unit so that signals generated by the measurement unit are fed to the regulating unit.

14. System according to claim 13, including a measuring member positioned at an exit of the drawing unit for monitoring a parameter associated with the sliver, said measuring member being connected to the regulating unit so that signals produced by the measuring member are sent to the regulating unit.

15. System according to claim 14, wherein the measuring member at the entrance of the drawing unit is formed by a grooved-and tracer-roller measuring member, and the measuring member at the exit of the drawing unit is a fibre-compression measuring member.

* * * * *